United States Patent [19]

Goodale

[11] Patent Number: 4,799,277

[45] Date of Patent: Jan. 24, 1989

[54] HYBRID WATERMATTRESS HAVING CONCAVE SOFTSIDES

[75] Inventor: Clarke W. Goodale, Simi; Valley, Calif.

[73] Assignee: American-National Watermattress Corporation, Anaheim, Calif.

[21] Appl. No.: 175,680

[22] Filed: Mar. 21, 1988

Related U.S. Application Data

[63] Continuation of Ser. No. 899,842, Aug. 25, 1986, abandoned.

[51] Int. Cl.[4] ..... A47C 27/08

[52] U.S. Cl. ..... 5/451; 5/474

[58] Field of Search ..... 5/451, 452, 450, 422, 5/481, 474, 400

[56] References Cited

U.S. PATENT DOCUMENTS

| | | | |
|---|---|---|---|
| 3,742,531 | 7/1973 | Alsbury et al. | 5/451 |
| 4,015,299 | 4/1977 | Tinnel | 5/451 |
| 4,057,862 | 11/1977 | LaBianco | 5/451 |
| 4,145,780 | 3/1979 | Fogel | 5/451 |
| 4,186,455 | 2/1980 | Fox et al. | 5/451 |
| 4,187,566 | 2/1980 | Peterson | 5/451 |
| 4,197,602 | 4/1980 | Johenning | 5/451 |
| 4,221,013 | 9/1980 | Echevarria | 5/451 |
| 4,245,361 | 1/1981 | Evanson | 5/451 |
| 4,571,762 | 2/1986 | Rhoton et al. | 5/451 |

*Primary Examiner*—Alexander Grosz

*Attorney, Agent, or Firm*—Richard L. Myers

[57] ABSTRACT

A hybrid watermattress has a compressible sidewall, a water fillable bladder, and a cover to envelope the bladder and the sidewall. The sidewall extends laterally and peripherally of the bladder, and in an uncompressed state, has a generally concave cross section that is complementary to the lateral panels of the bladder.

15 Claims, 1 Drawing Sheet

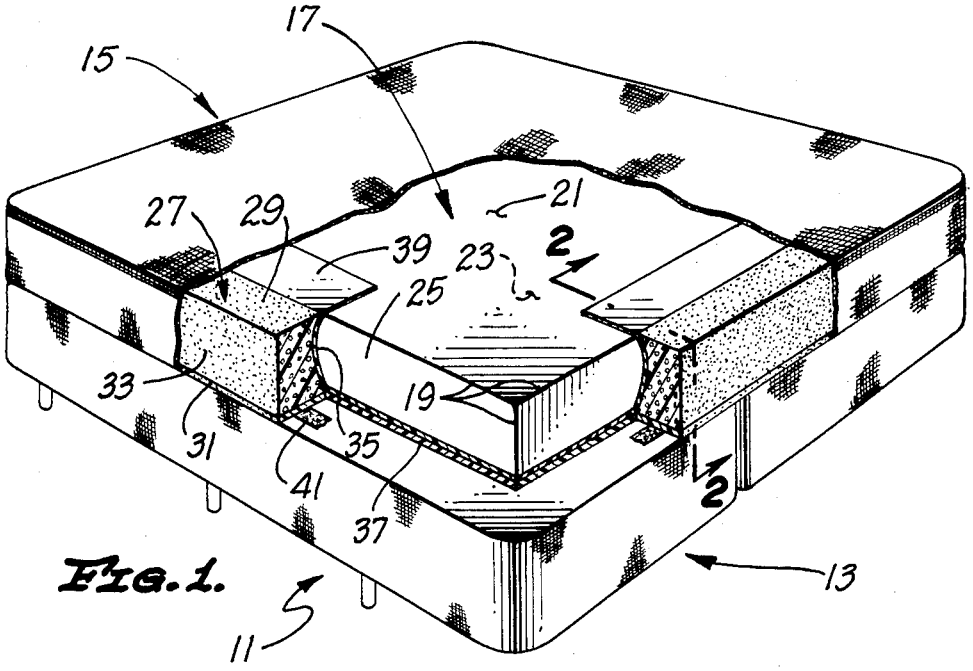
FIG. 1.
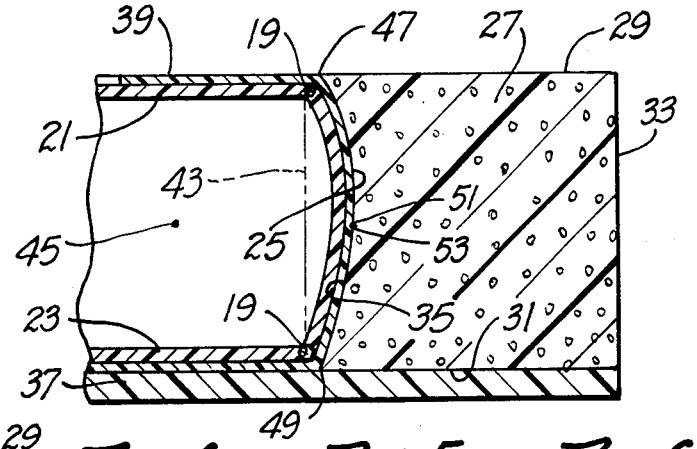
FIG. 2.
FIG. 3.
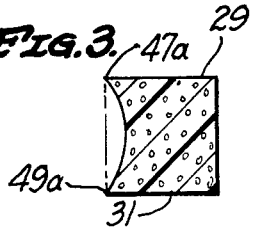
FIG. 4.
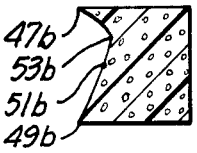
FIG. 5.
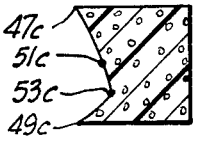
FIG. 6.
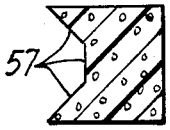
FIG. 7.
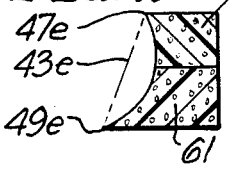
FIG. 8.
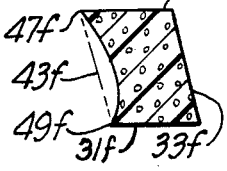
FIG. 9.
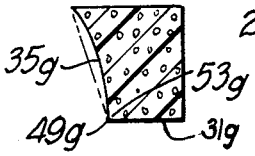
FIG. 10.
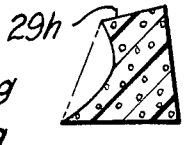

HYBRID WATERMATTRESS HAVING CONCAVE SOFTSIDES

This application is a continuation of application Ser. No. 899,842 filed Aug. 25, 1986 entitled HYBRID WATERMATTRESS HAVING CONCAVE SOFTSIDES, now abandoned.

BACKGROUND OF THE INVENTION

1. Field of the Invention

The present invention relates generally to hybrid waterbed mattresses including in a single envelope a bladder and foam softsides providing lateral support for the bladder.

2. Discussion of the Prior Art

Hybrid watermattresses typically include a waterbladder which is disposed centrally of the mattress, and a plurality of sidewalls typically formed of a resilient grade foam material which surround the bladder at the lateral edges of the mattress. These sidewalls are commonly referred to as "softsides". It is the purpose of the softsides not only to provide lateral support for the bladder but also to provide a more conventional surface on which one can sit at the edge of the mattress. A quilted ticking provides an envelope which encloses both the bladder and the softsides. This construction forms a hybrid watermattress having substantially the same appearance as the more conventional innerspring mattress, while affording the luxury of a flotation sleeping surface.

In the past, softsides have been constructed with generally flat surfaces facing the mattress bladder. These surfaces have been designed to complement the manufactured shape of the bladder but have failed to appreciate that the shape of the bladder in normal use changes drastically. For example, the lateral surface of a bladder which is manufactured to be vertical achieves an arcuate shape when it is filled with water. In general, all flat shapes of the bladder will tend to balloon under the pressure of the water within the water cavity.

Attempts to support these ballooning arcuate surfaces with the flat surface of the softsides has created uneven pressures on the material of the bladder. Representative of this prior art is the watermattress disclosed in U.S. Pat. No. 4,571,762. The greatest pressures have tended to locate in the areas of the seams and thereby developed points of weakness for the bladder.

Of course one of the greatest concerns in any mattress having a water filled bladder is the integrity of that container. If even a pinhole develops at the seam or any other location, large volumes of water can be released into the surrounding area. Thus the watermattress industry is always interested in reducing the stress on the seams of the bladder.

SUMMARY OF THE INVENTION

In accordance with the present invention, the normal shape of the waterbladder is taken into consideration in designing a complementary supporting surface for the softsides. The word "complementary" as used herein refers to the softside supporting surface which is substantially the reverse shape of the lateral bladder surface when the bladder is in normal use. This shape tends to equalize the supporting pressures upon the lateral bladder surface. "Normal use" refers to the state of the bladder when filled with water to a depth recommended by the manufacturer. The "shape" of the softside refers to its cross-sectional configuration in an uncompressed state.

In a particular embodiment, a bladder is manufactured with a generally vertical lateral surface but under pressure this surface achieves a cross-sectional shape forming the arc of a circle. In order to accommodate this bladder with substantially equal supporting pressures along this lateral surface, the supporting surface of the softside is provided with a shape which in cross-section also forms the arc of a circle. The convex shape of the bladder when supported by the complementary concave shape of the softside reduces the pressures along the seams, particularly at the corners of the bladder.

This interface between the watermattress and softside provides a further advantage to a person sitting on the edge of the bed. Along a vertical plane at this interface, one will encounter some foam and some water support thereby creating a gradual transition between the foam support of the softside and the flotation support of the bladder.

These and other features and advantages of this hybrid waterbed will become more apparent with a description of preferred embodiments and reference to the associated drawings.

BRIEF DESCRIPTION OF THE DRAWINGS

The accompanying drawings, which are incorporated in and form a part of the Specification, illustrate many embodiments of the invention, and, together with Description, serve to explain the principles of the invention.

FIG. 1 is a perspective view of a hybrid waterbed partially in phantom to illustrate the interior bladder and softside associated with the present invention;

FIG. 2 is a cross-section view taken along lines 2—2 of FIG. 1, and illustrating a preferred embodiment of the mattress and softside combination of this invention;

FIGS. 3 through 10 are cross-sectional views similar to FIG. 2 each illustrating a different embodiment of the softside of the present invention, and each adapted to complement a particular bladder construction and the shape that particular bladder achieves when in normal use.

DESCRIPTION OF PREFERRED EMBODIMENTS

Referring now to FIG. 1, a hybrid waterbed is illustrated and designated generally by the reference numeral 11. Included in this waterbed is a foundation 13 which can be of any conventional variety including those having metal innersprings (not shown). In the illustrated embodiment, a hybrid watermattress 15 is adapted to sit on the foundation 13 and provide a sleeping or sitting surface for one or more persons.

The watermattress 15 includes a waterbladder 17 which is disposed centrally of the watermattress 15 and adapted to be filled with water to provide a flotation sleeping surface. The bladder 17 is typically formed of individual sheets of plastic material which are heat sealed together to form seams such as those illustrated at 19. The bladder 17, for example, may include a top panel 21, a bottom panel 23, and a side panel 25 which extends between the top and bottom panels 21 and 23, respectively. It is the configuration of the bladder's side panel 25 which is of particular interest to the present invention.

The side panel 25 may be manufactured to have any configuration. For example, it might be manufactured to have a vertical configuration extending generally perpendicular between the peripheral edges of the top and bottom panels 21 and 23, respectively. It might also be configured to slant inwardly and/or outwardly with progressive positions from the top panel 21 to the bottom panel 23.

The bladder 17 is supported in a lateral direction by a sidewall 27 commonly referred to as a "softside". This sidewall 27 extends around the four sides of the bladder 17 and keeps the bladder 17 from rolling or flowing off of the foundation 13. In the illustrated embodiment, the sidewall 27 includes a top surface 29, a bottom surface 31, an outer surface 33, and an inner surface 35 which faces the bladder 17.

The sidewall 27 is typically formed from a foam material which is glued along its bottom surface 31 to a foam panel which extends not only beneath the sidewall 27 but also beneath the entire bladder 17. Thus the sidewall 27 in combination with the foam panel 37 forms a cavity on top of the foundation 13 which is adapted to receive the bladder 17. A safety liner 39 is commonly provided to line this cavity in case any leaks develop in the bladder 17. The foam panel 37 with the sidewall 27 adhered thereto can be releasably held in place by a hook and loop strip 41 preferably positioned near the edge of the top surface of the foundation 13.

FIG. 2 illustrates in greater detail the interface between the side panel 25 of the bladder 17 and the inner surface 35 of the sidewall 27. In this enlarged view, it can be seen that the side panel 25 of the bladder 17, which might be manufactured to have a vertical configuration represented by the dotted line 43, would tend toward a more arcuate configuration under the pressure of water. Of course this is the state of the mattress when in normal use.

It is the purpose of this invention to reduce the pressure on the seams 19 by providing the inner surface 35 of the sidewall 27 with a shape which is similar or generally complementary to that of the side panel 25. Thus, if the side panel 25 has an arcuate and convex configuration, the surface 35 can be provided with an arcuate but concave configuration.

In the cross-sectional view of FIG. 2, the side panel 25 of the bladder 17 and supporting inner surface 35 of the sidewall 27, each define the arc of a circle. The center of each of these circles is coincident at the point 45. In other embodiments the panel 25 and the surface 35 might have similar shapes but different sizes.

In the illustrated embodiment, the top panel 21 of the bladder 17 is generally an extension of the top surface 29 of the sidewall 27. Similarly, the bottom panel 23 is an extension of the bottom surface 31 of the sidewall 27.

The inner surface 35 of the sidewall 27 forms a line with the top surface 29 which appears as a top point 47 in the cross-section view of FIG. 2. Similarly, this surface 35 forms a line with a bottom surface 31 which appears as a bottom point 49 in FIG. 2. Vertically equidistant between these two points 47 and 49 is a mid point designated by the reference numeral 51. In this cross-sectional view, the surface 35 extends inwardly of the side wall 27 from the point 47 with progressive positions to the mid point 51. From the point 51, the surface 35 extends outwardly of the sidewall 27 with progressive positions toward the point 49. Thus the midpoint 51 in this embodiment represents the innermost extension of the surface 35, a point which will hereinafter be referred to as the innermost point 53.

These features of the embodiment illustrated in FIG. 2 will help distinguish the other embodiments of this invention which are illustrated in FIGS. 3 through 10. In these cross-sectional views, only the configuration of the softside 27 is illustrated.

The embodiment of FIG. 3 is the same as that illustrated in . FIG. 2 but provides a better representation of a feature associated with several of the embodiments of the present invention. This feature is characterized by a top point **47*a* and bottom point 49*a* which lie along a common vertical line which is substantially perpendicular to the top surface 29 and bottom surface 31 of the sidewall 27**.

This feature can also be found in the embodiment of FIG. 4. However in this case, it will be noted that the degree of curvature between the top point **47*b* and the midpoint 51*b* is greater that between the midpoint 51*b* and the bottom point 49*b*. In this embodiment, the innermost point 53*b* lies between the top point 47*b* and the midpoint 51*b***.

In contrast, the embodiment of FIG. 5 illustrates that the innermost point **53*c* can be disposed between the midpoint 51*c* and the bottom point 49*c*. In this case, there is a lesser degree of curvature between the top point 47*c* and the midpoint 51*c* than it has between the midpoint 51*c* and the bottom point 49*c***.

FIG. 6 illustrates that any of these embodiments associated with the surface 35 of the sidewall 27 can be approximated with a plurality of straight lines 57.

FIG. 7 illustrates an embodiment wherein the top point **47*e* and the bottom point 49*e* are not vertically aligned. This configuration would be particularly adapted to accommodate a bladder 17 having a side panel 25 which is manufactured to slant inwardly from top to bottom, for example along the dotted line 43*e*. The embodiment of FIG. 7 also illustrates that the sidewall 27 in any of these embodiments may include an upper portion 59 formed of high density foam and a lower portion 61** formed of low density foam.

In the FIG. 8 embodiment, the top point **47*f* is disposed vertically inwardly from the bottom point 49*f*. This embodiment would be of particular advantage to a mattress wherein the side panel 25 slopes outwardly from top to bottom, for example along the dotted line 43*f***.

FIG. 8 also illustrates that any of these sidewalls 27 may have an outer surface **33*f* which slants outwardly with progressive positions from the top surface 29*f* to the bottom surface 31*f*. With the force of the bladder 17 pressing against the sidewall 27, this feature would tend to leave the outer surface 33*f*** with a vertical configuration under normal use.

FIG. 9 illustrates an embodiment wherein the innermost point **53*g* is substantially coincident with the bottom point 49*g*. In this embodiment, the inner surface 35*g* is substantially perpendicular to the bottom surface 31*g* at the point 49*g***.

Finally, FIG. 10 illustrates a feature which can be applied to any of these embodiments, wherein the top surface **29*h* is manufactured to slant inwardly and downwardly so that in normal use, under the pressure of the bladder 17, this surface 29*h*** would be pushed upwardly and outwardly to a horizontal configuration.

Having described these preferred embodiments, it will now be apparent to those skilled in the art that the advantages of this concept can be appreciated in many other shapes, forms and configurations. For this reason, the scope of this invention should be ascertained only with reference to the following claims.

I claim:

1. A hybrid watermattress comprising:

a bladder formed of flexible sheet material and adapted to be filled with water;

the sheet material including a major top panel, a major bottom panel, and at least one lateral panel connecting the top panel and the bottom panel, the lateral panel having an initial shape as the bladder is manufactured and assuming a convex shape when the bladder is filled with water, said initial and convex shapes being different;

a compressible sidewall extending laterally around the bladder and having a supporting surface which faces the lateral panel of the bladder;

the supporting surface of the sidewall in an uncompressed state having a concave shape generally complementary to the convex shape of the lateral panel; and a mattress cover disposed to envelope the bladder and the sidewall of the watermattress.

2. The hybrid watermattress set forth in claim 1 wherein the convex shape in radial cross-section defines the arc of a circle.

3. The hybrid watermattress recited in claim 2 wherein the sidewall has a top surface which is substantially coplanar with the top panel of the bladder, and a bottom surface which is substantially coplanar with the bottom panel of the bladder; and the center of the circle is midway between the top surface and the bottom surface of the sidewall.

4. The hybrid watermattress recited in claim 1 wherein said initial shape in radial cross section is flat.

5. A watermattress comprising:

a bladder formed of water impervious sheet material and having a major top panel, a major bottom panel, and a side panel;

the bladder having characteristics for being filled with water, the side panel having an initial flat shape when the bladder has no water within it and a first particular convex shape when the bladder is filled with water;

a compressible sidewall extending laterally of the bladder for supporting the bladder, the sidewall having a top surface, a bottom surface, and a side surface facing the side panel of the bladder;

the side surface of the sidewall having a second particular concave shape when the sidewall is in a generally uncompressed state;

the first particular convex shape being generally complementary to the second particular concave shape; and a mattress cover surrounding the bladder and the sidewall.

6. The watermattress recited in claim 5 wherein the first particular shape in cross-section forms the arc of a first circle; and the second particular shape in cross-section forms the arc of a second circle.

7. The watermattress set forth in claim 6 wherein the center of the first circle and the center of the second circle are coincident.

8. The watermattress recited in claim 6 wherein the center of the first circle and the center of the second circle are disposed midway between the top panel of the bladder and the bottom panel of the bladder.

9. The watermattress recited in claim 5 wherein the major top panel of the bladder is substantially coplanar with the top surface of the sidewall, and the major bottom panel of the bladder is substantially coplanar with the bottom surface of the sidewall.

10. A watermattress comprising:

a bladder adapted to be filled with water;

a compressible sidewall extending laterally, peripherally of the bladder, the sidewall, in an uncompressed state, having a particular surface facing inwardly toward the bladder for supporting the bladder; and the particular surface in cross-section extending from a top point inwardly of the sidewall, through an innermost point and a midpoint, and outwardly of the sidewall to a bottom point.

11. The watermattress recited in claim 10 wherein the innermost point is coincident with the midpoint.

12. The watermattress set forth in claim 10 wherein the particular surface in cross-section extends inwardly with progressive positions from the top point to the innermost point and outwardly with progressive positions from the innermost point to the bottom point.

13. The watermattress set forth in claim 10 wherein the midpoint lies between the top point and the innermost point.

14. The watermattress recited in claim 10 wherein the midpoint lies between the innermost point and the bottom point.

15. A hybrid watermattress comprising:

a bladder formed of flexible sheet material and adapted to be filled with water;

the sheet material including a major top panel, a major bottom panel of substantially the same size and shape as the top panel, and at least one lateral panel connecting the top panel and the bottom panel, the lateral panel having a generally vertical initial shape as the bladder is manufactured and assuming a particular convex shape in cross section when the bladder is filled with water, said initial and particular shapes being different;

a compressible sidewall extending laterally around the bladder and having a supporting surface which faces the lateral panel of the bladder;

the supporting surface of the sidewall in an uncompressed state having a concave shaped generally complementary to the particular convex shape of the lateral panel; and a mattress cover disposed to envelope the bladder and the sidewall of the watermattress.

* * * * *